US006374569B1

(12) United States Patent
Suckow

(10) Patent No.: US 6,374,569 B1
(45) Date of Patent: Apr. 23, 2002

(54) VIBRATING SCREED AND METHOD FOR USING SAME

(76) Inventor: Robert E. Suckow, 515 First St. North, Maynard, IA (US) 50655

( * ) Notice: Subject to any disclaimer, the term of this patent is extended or adjusted under 35 U.S.C. 154(b) by 0 days.

(21) Appl. No.: 09/548,542

(22) Filed: Apr. 13, 2000

(51) Int. Cl.[7] ..... E04G 21/20

(52) U.S. Cl. ..... 52/749.13; 15/235.4; 403/78; 404/114; 404/118

(58) Field of Search ..... 52/749.13, 749.1; 404/114, 118, 97, 133.1; 403/78, 79; 15/235.7, 235.8, 235.4

(56) References Cited

U.S. PATENT DOCUMENTS

| | | | | | |
|---|---|---|---|---|---|
| 4,073,593 | A | | 2/1978 | Storm | |
| 4,340,351 | A | | 7/1982 | Owens | |
| 4,359,296 | A | | 11/1982 | Cronkhite | |
| 4,386,901 | A | | 6/1983 | Morrison | |
| 4,520,527 | A | * | 6/1985 | Maggio et al. | 15/235.8 |
| 4,641,995 | A | | 2/1987 | Owens | |
| 4,752,156 | A | * | 6/1988 | Owens | 404/118 |
| 4,838,730 | A | * | 6/1989 | Owens | 404/118 |
| 5,102,258 | A | | 4/1992 | Berger | |
| 5,190,401 | A | * | 3/1993 | Wilson | 404/118 |
| 5,234,283 | A | | 8/1993 | Adkins | |
| 5,244,305 | A | | 9/1993 | Lindley | |
| 5,372,452 | A | | 12/1994 | Hodgson | |
| 5,375,942 | A | | 12/1994 | Lindley et al. | |
| 5,687,448 | A | * | 11/1997 | Dye, Jr. | 15/235.8 |
| 5,803,656 | A | * | 9/1998 | Turck | 404/103 |
| 5,837,298 | A | | 11/1998 | Face, Jr. et al. | |
| 6,089,787 | A | * | 7/2000 | Allen et al. | 404/118 |
| 6,200,065 | B1 | * | 3/2001 | Eitzen | 404/114 |
| 6,227,750 | B1 | * | 5/2001 | Maggio et al. | 403/79 |
| 6,231,331 | B1 | * | 5/2001 | Lievers | 425/13 |

* cited by examiner

*Primary Examiner*—Carl D. Friedman
*Assistant Examiner*—Yvonne M. Horton
(74) *Attorney, Agent, or Firm*—McKee, Voorhees & Sease, P.L.C.

(57) ABSTRACT

A screed device includes a screed plate having two arms separately attached at their lower ends to the screed plate. The arms are pivotally attached to the screed plate for pivotal movement about both a vertical axis and a horizontal axis.

12 Claims, 7 Drawing Sheets

Top View

Top View

VIBRATING SCREED AND METHOD FOR USING SAME

BACKGROUND OF THE INVENTION

The present invention relates to a vibrating screed and method for using same.

Screeds have been used for leveling and consolidating on curing concrete. These screeds usually include a horizontal member which is moved across the surface of the concrete to level the concrete and prepare it for finishing. Vibrators are sometimes used to cause the screed to vibrate against the surface of the concrete to consolidate it.

Some prior art screeds utilize an internal combustion engine mounted on the screed plate for causing the vibration of the screed plate. These internal combustion engines are heavy and add substantially to the weight of the screed.

Other screed devices utilize an electric motor requiring a cord to extend from the screed to an electrical outlet. These cords often drag on the concrete and deform the surface of the concrete. There is also a safety hazard with electrical cords because the concrete is wet.

Many prior art screed devices have one or more handles for moving the screed plate across the surface of the concrete. However, these handles are usually attached to the screed plate rigidly or in a manner which prevents rotation of the handles relative to the screed plate about a vertical axis. Consequently the operator often has difficulty maneuvering the screed plate into a more narrow space or around objects such as electrical outlets in the floor or other objects.

It is also desirable to be able to adjust the angle of the screed plate relative to the concrete surface. Sometimes it is desirable to lift the leading edge of the screed plate to allow more concrete under the plate for filling low areas. Other times it is desirable to lift the trailing edge of the screed plate to remove concrete from a high spot. It is preferable that the lifting of the leading or trailing edges of the screed plate be done independently of the handles attached to the screed plate so that the handles can remain at the same angle relative to the operator even though the leading and trailing edges of the screed plate may be adjusted.

Therefore a primary object of the present invention is the provision of an improved vibrating screed and method for using same.

A further object of the present invention is the provision of a vibrating screed which is easy to handle when transporting and which may be easily assembled and disassembled with no tools needed.

A further object of the present invention is the provision of an improved screed plate which is self-adjusting to any operator's height.

A further object of the present invention is to provide a vibrating screed which can switch and interchange the handles from right to left or left to right.

A further object of the present invention is the provision of a vibrating screed which has a stand that is easy to raise and lower.

A further object of the present invention is the provision of a vibrating screed plate which has instant response to a variable speed control switch and which utilizes a rechargeable battery pack rather than an internal combustion engine or an electric cord.

A further object of the present invention is the provision of a screed plate which can be angled merely by pushing and pulling on the two handles so as to permit the screed plate to enter narrow areas and so as to permit the maneuverability of the screed plate into corners and around electrical or plumbing protrusions in the floor.

A further object of the present invention is the provision of a screed plate which is lightweight in design so that all the force is put into the blade for vibration as compared to heavier screed plates which utilize internal combustion engines.

A further object of the present invention is the provision of a vibrating screed plate having a tilting mechanism for tilting the leading and trailing edges of the plate independently from the angle of the handles.

A further object of the present invention is the provision of a vibrating screed plate which can be operated in enclosed areas without causing harmful emissions or fumes.

A further object of the present invention is the provision of a vibrating screed plate that will adapt for manual use of a laser for leveling.

A further object of the present invention is the provision of an improved screed plate which does not require electrical cords to be drug through the concrete and which does not present a hazard of electrical shock to the operator.

DETAILED DESCRIPTION OF THE PREFERRED EMBODIMENT

Figure 1:
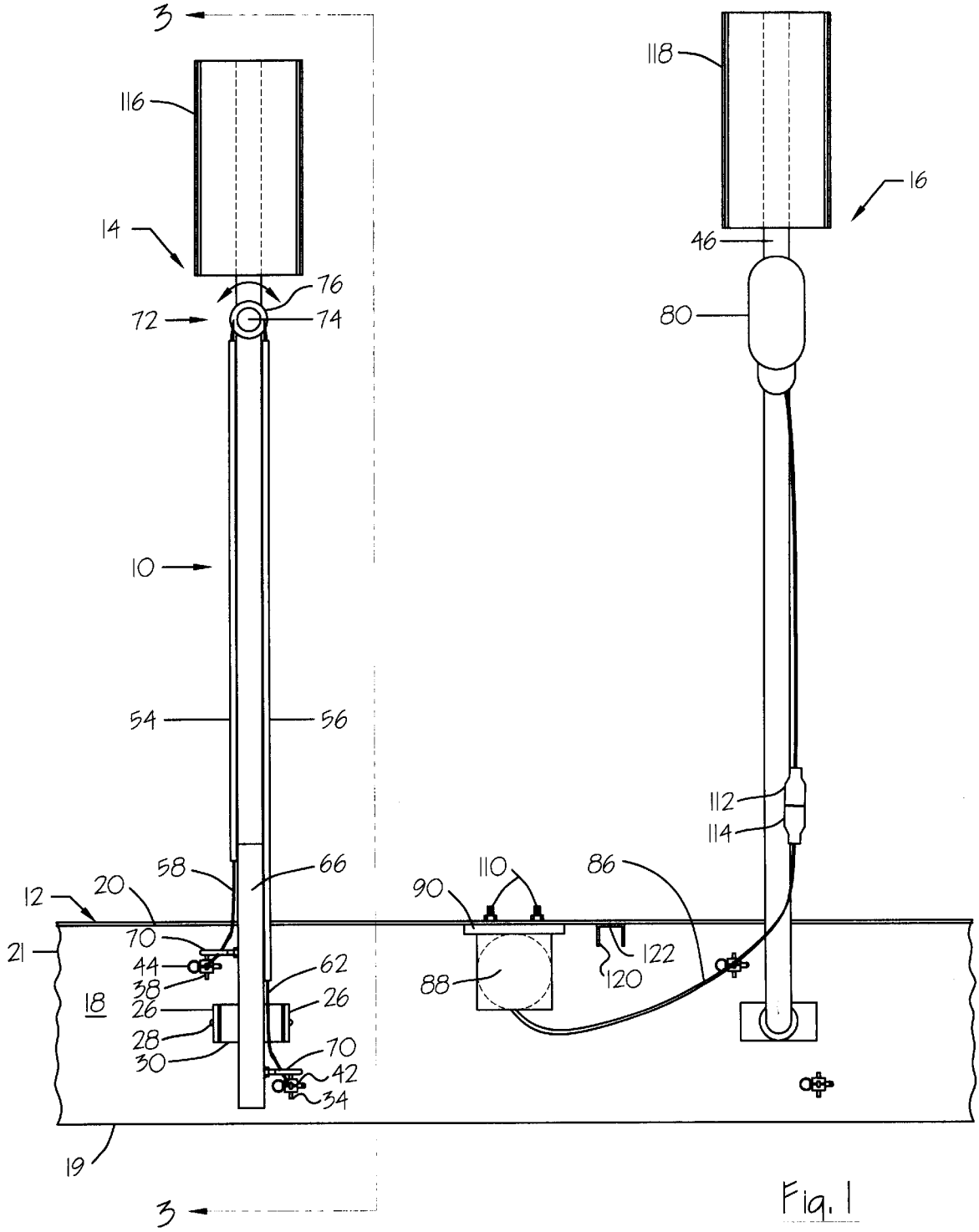
FIG. 1 is a top plan view of the vibrating screed of the present invention.

Referring to FIG. 1 the numeral 10 generally designates the screed device of the present invention. Device 10 includes a screed plate 12 and first and second arms 14, 16. Screed plate 12 includes a horizontal screed surface 18, the bottom portion of which is intended to engage the upper surface of the concrete being treated.

The horizontal screed surface includes a trailing edge 19 and a leading edge 21. At the leading edge 21 is a vertical screed surface 20 so that the screed plate 12 has an L-shaped cross sectional configuration. Vertical surface 20 permits a build up of concrete as the screed plate 12 is pulled across the concrete surface.

Figure 4:
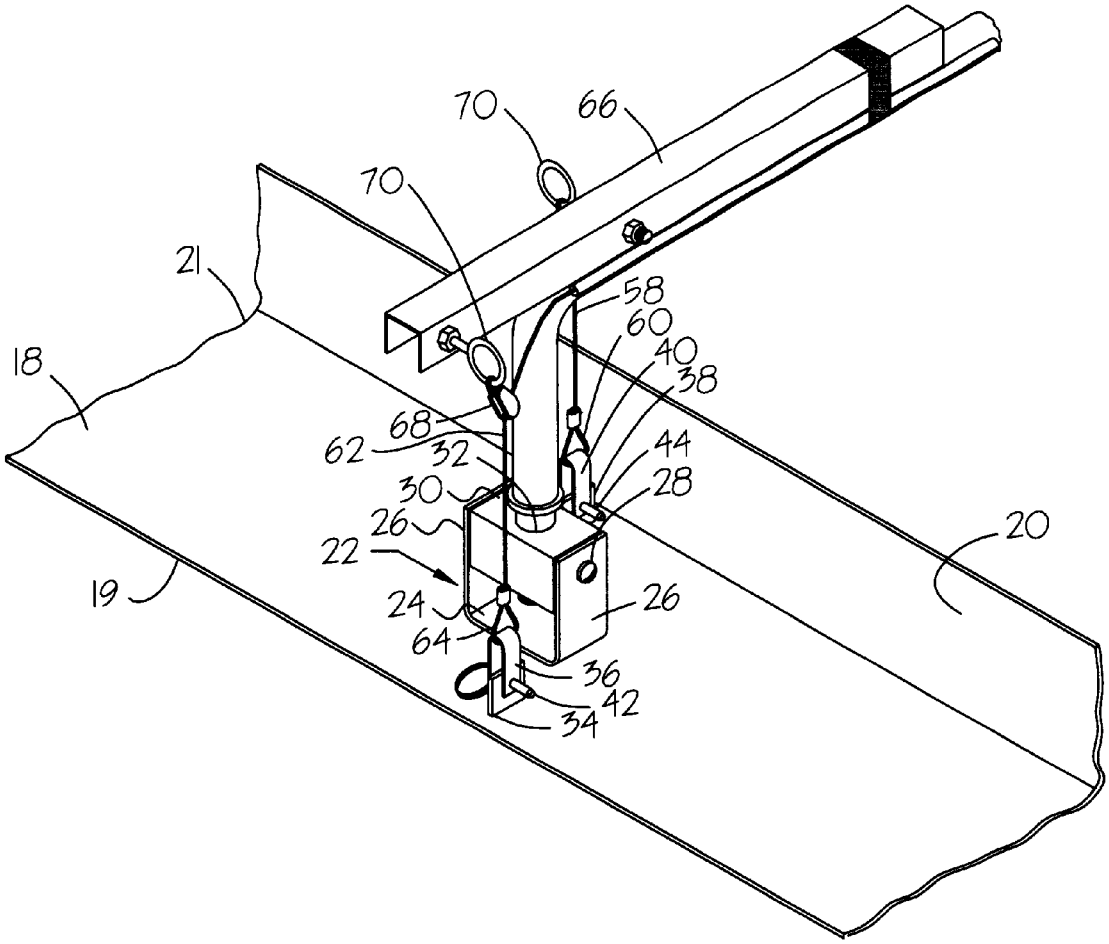
FIG. 4 is an enlarged detail of the connection of the left-hand handle (as viewed in FIG. 1) to screed plate.

As seen in FIG. 4, a U-shaped bracket 22 is mounted to the horizontal surface 18 by welding, bolting or other convenient means. U-shaped bracket 22 includes a web 24 and a pair of spaced apart upstanding legs 26. A pivot pin 28 extends through the legs 26 and also into a pivoting block 30 so as to permit the block 30 to pivot about the horizontal axis provided by pivot pin 28. Block 30 includes an upstanding arm receiving hole 32 for receiving the lower ends of the arms 14, 16 as will be described in more detail hereafter.

Mounted on the horizontal surface 18 adjacent the leading edge 19 thereof is a leading ear 34 to which is mounted a U-shaped bracket 36 by means of a removable pin 42. Similarly a trailing edge ear 38 is mounted adjacent the trailing edge 21 and includes a U-shaped bracket 40 mounted by means of a removable pin 44.

Figure 3:
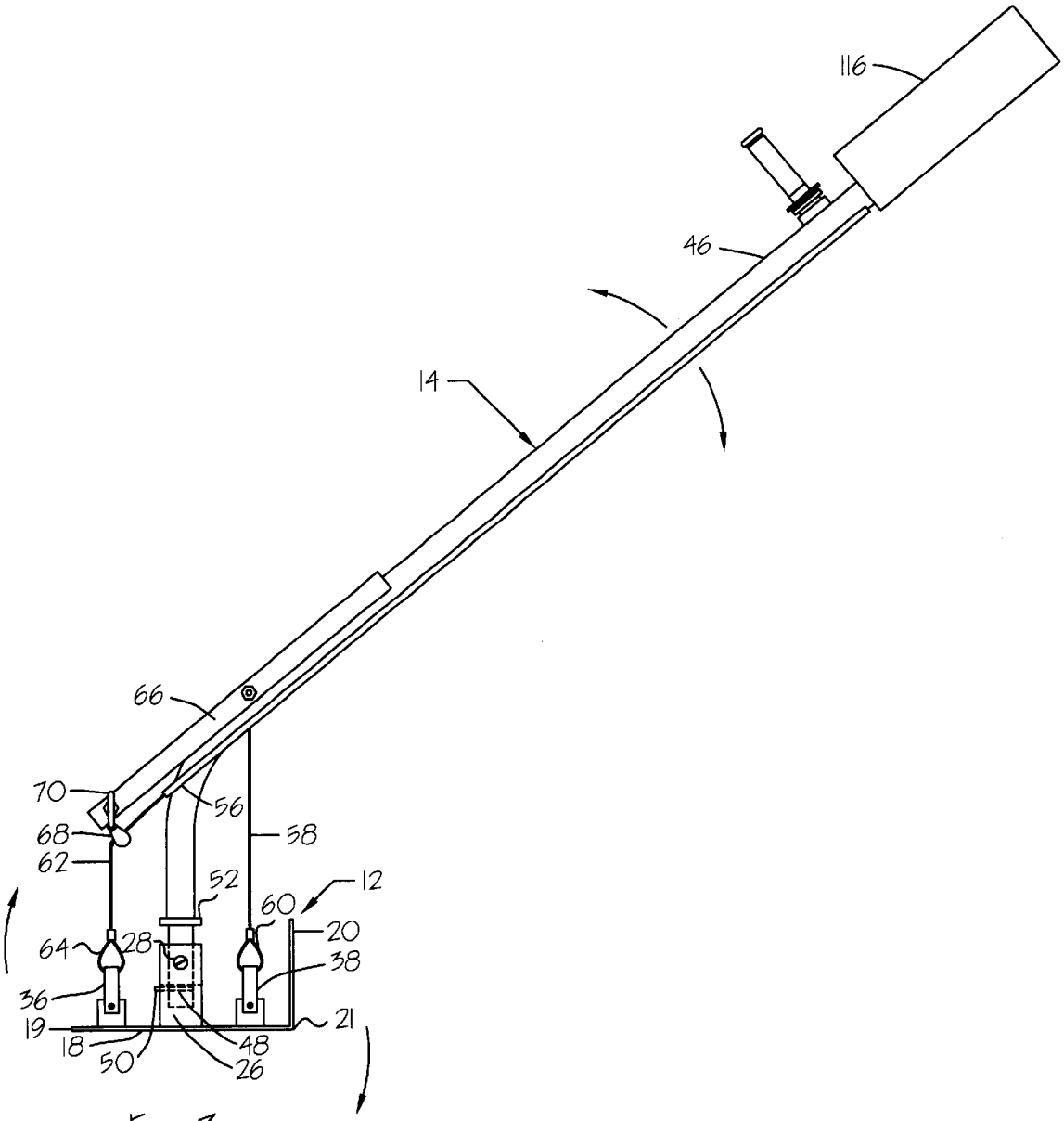
FIG. 3 is a side elevational view of the left-hand handle as viewed along line 3—3 of FIG. 1.

Referring to FIG. 3 the first arm 14 includes a handle end 46 and a bent lower end 48 which slides downwardly within the arm receiving hole 32 in pivoting block 30. The lower end of the arm 14 is held within the arm receiving hole 32 by means of a removable pin 50. An enlarged flange 52 adjacent the lower end 48 of arm 14 limits the downward movement of the arm within the arm receiving hole 32.

Attached to arm 14 are a short cable tube 54 (FIG. 1) and a long cable tube 56. Sliding through the short cable tube 54 is a short cable 58 and sliding through the long cable tube 56 is a long cable 62. At the lower end of short cable 58 is a short cable loop 60 (FIG. 4) which loops around U-shaped bracket 40. The long cable 62 includes a long cable loop 64 which loops around the U-shaped bracket 36. Short and long cables 54, 62 are flexible members.

Attached to the arm 14 adjacent the bent portion at the lower end thereof is a cable extension bracket 66 which includes at its outer end a pulley 68 pivotally mounted to a pulley eye 70. A similar pulley eye 70 and pulley (not shown) are mounted at the lower end of short cable tube 54 and receive the short cable 58.

Figure 5:
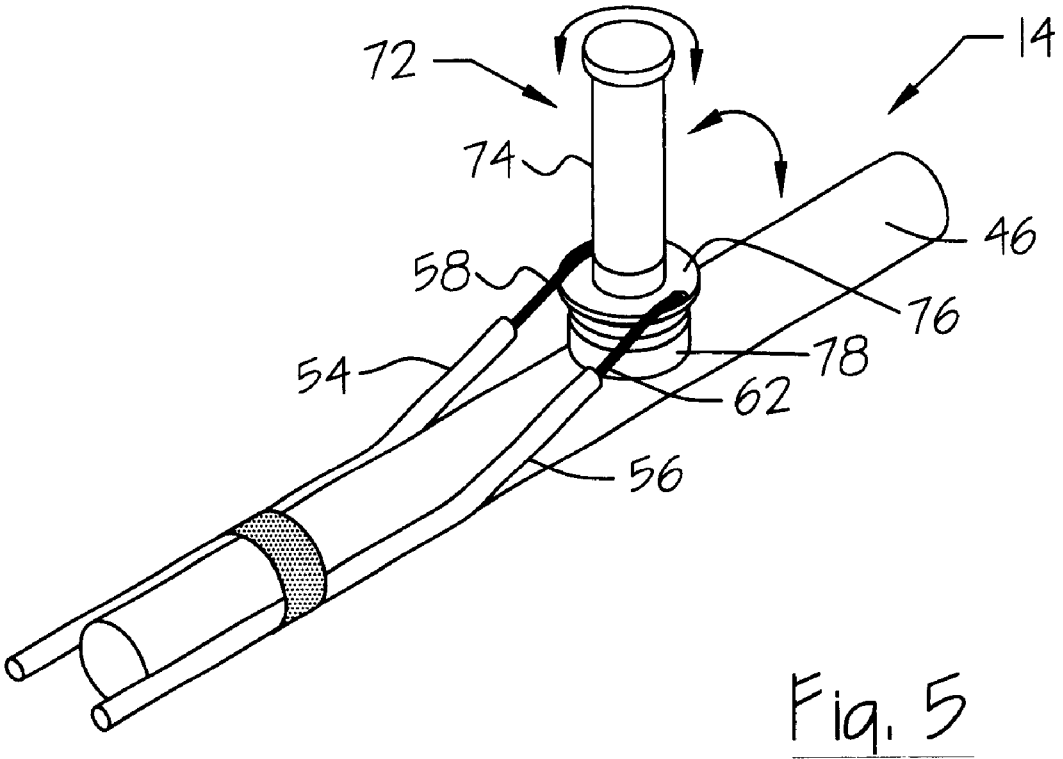
FIG. 5 is a detailed perspective view of the tilt control mechanism of the present invention.

At the upper end of arm 14 is a tilt control 72 (FIG. 5). Tilt control 72 includes a control handle 74 having an annular handle flange 76 thereon. Control handle 74 and annular flange 76 are pivotally mounted with respect to a control base member 78 which in turn is attached to the upper end 46 of arm 14. The upper ends of the cables 58, 62 are connected at opposite sides to the flange 76. Rotation of handle 74 causes the flange 76 to rotate and consequently causes one of the cables 62 to be placed in tension. This results in the lifting of the edge of the screed plate to which the particular cable is attached. For example, pulling on cable 58 causes the leading edge 21 of the screed plate 12 to be lifted thereby permitting concrete built up behind vertical leg 20 in low spots. Pulling on cable 62 causes the trailing edge 19 of the screed plate to be lifted thereby causing concrete to be removed to lower high spots on the concrete surface. This gives the operator the ability to tilt the screed plate as desired in order to achieve the desired finish on the concrete.

Figure 6:
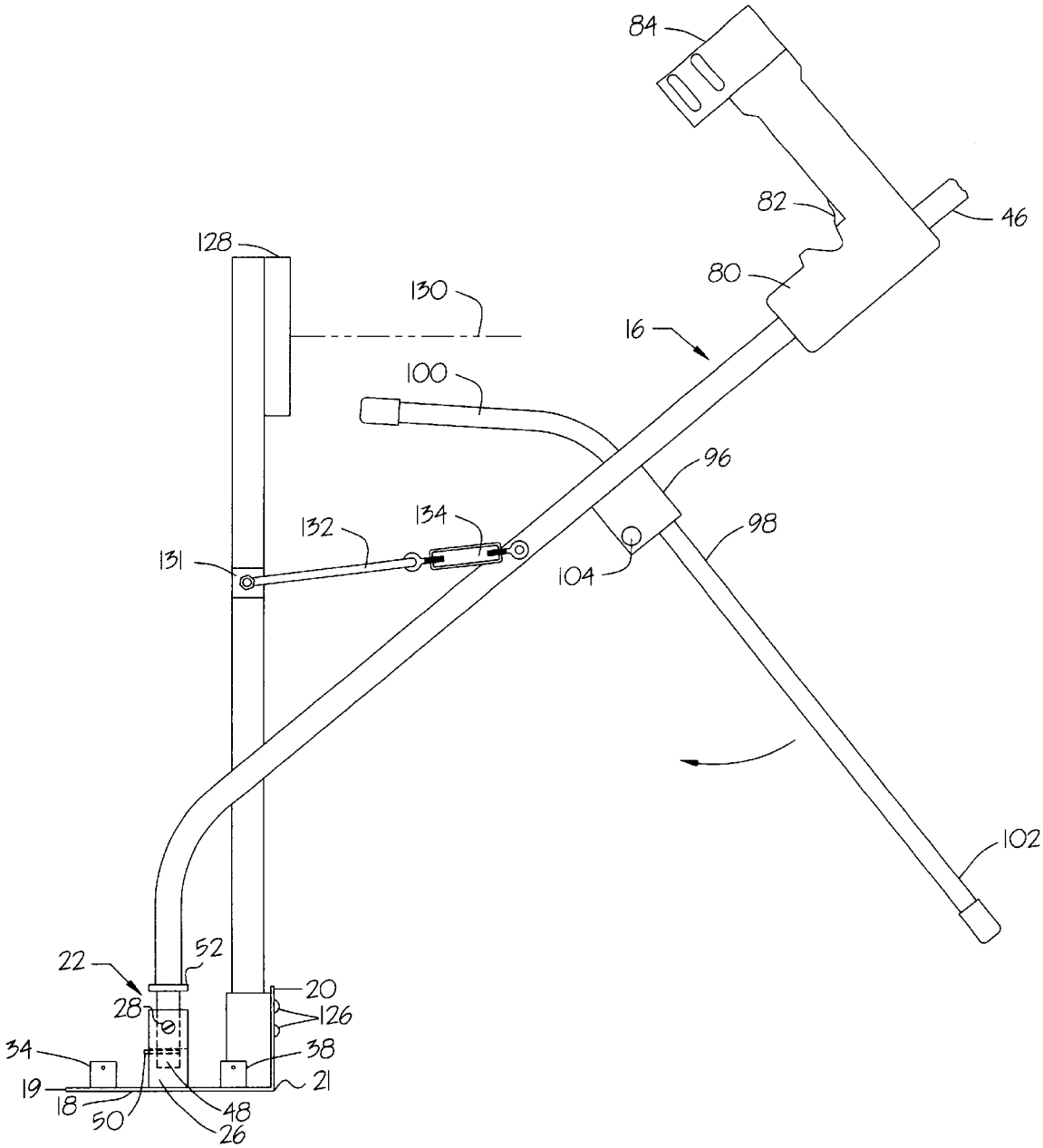
FIG. 6 is a side elevational view of the right-hand handle arm of FIG. 1.
Figure 7:
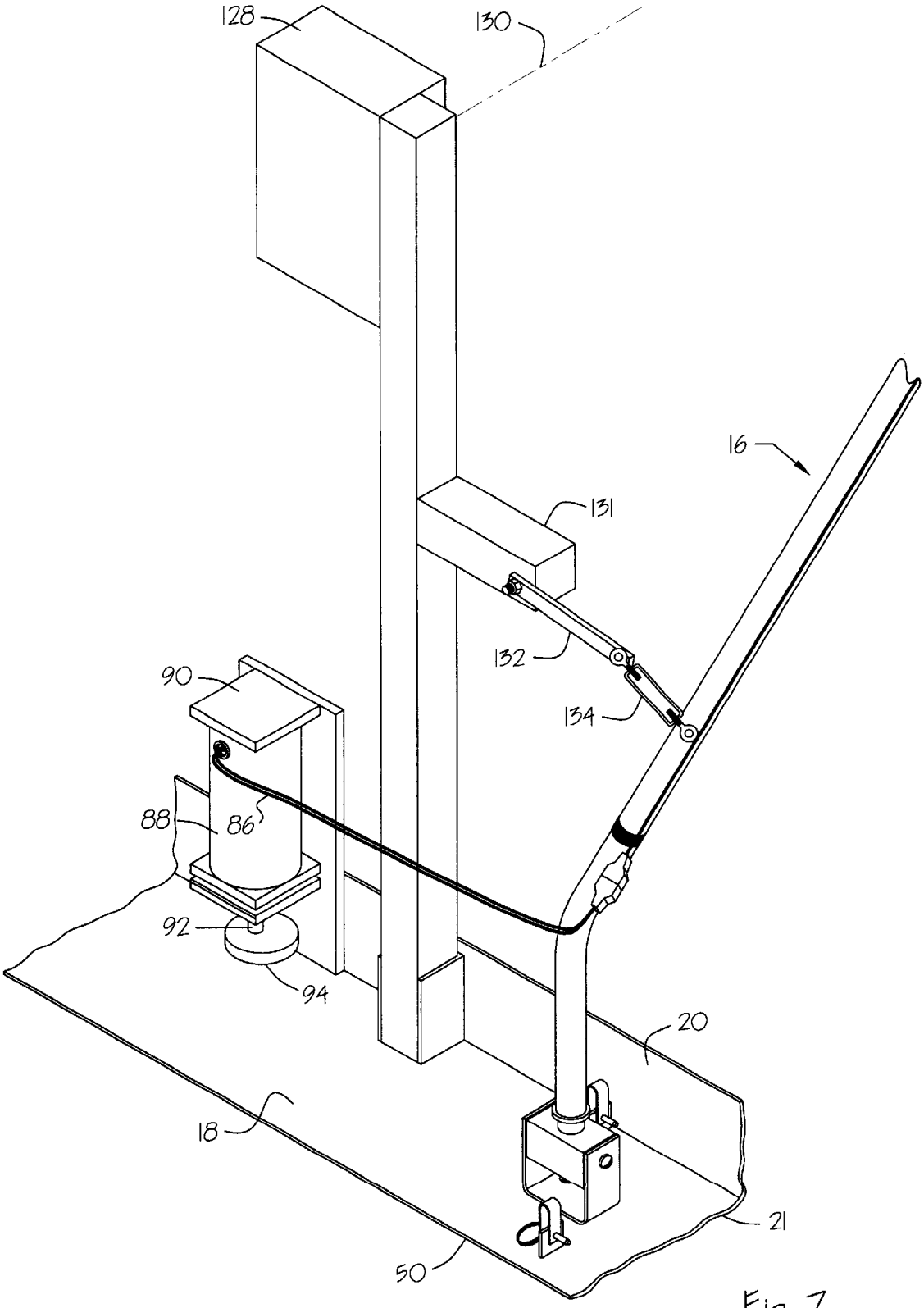
FIG. 7 is a detailed pictorial view of the vibrator used on the present invention employing a laser setup.

Referring to FIGS. 1, 6 and 7, a variable speed control 80 is mounted on the upper end 46 of handle 16. The variable speed control includes a trigger 82 and a rechargeable battery 84. Pressing the trigger 82 causes an electrical signal to be delivered down cable 86 to a variable speed motor 88. Motor 88 is mounted to the vertical leg 20 of the screed plate 12 by means of a motor mount 90 with two bolts 110. Variable speed motor 88 includes an output shaft 92 on which is mounted an eccentric wheel 94. Rotation of the output shaft 92 causes the eccentric wheel to vibrate against the upstanding leg 20 of the screed plate 12. Thus it is possible by pressing the trigger 82 to cause the motor 88 to be actuated and rotate the eccentric wheel 94 for vibrating the screed plate.

Referring to FIG. 6 a bracket 96 supports a leg stand 98 having an upper end 100 and a lower end 102. A pivot 104 permits the leg stand 98 to rotate about the pivot 104 from its upstanding position shown in FIG. 6 to a an inoperative position with the leg 98 substantially paralleling the arm 16. When it is desired to let go of the arms 14, 16 the operator can lower the leg stand 98 to prevent the arms 14, 16 from falling to the ground.

The present invention includes many advantages over the prior art. As can be seen by a comparison of FIGS. 1 and 2, it is possible to push on one of the arms 14, 16 and to pull on the other so as to cause the screed plate 12 to be disposed at an angle relative to the two arms 14, 16. This permits the operator to move the screed plate into the corner of a room or into an area which is narrower than the length of the screed plate. The ability to change the angle of the screed plate 12 is facilitated by the independent vertical pivotal actions of the lower ends of the arms 14, 16 within the arm receiving holes 32 of the blocks 30. Similarly the blocks 30 are pivotal about the horizontal axes provided by pins 28 so as to accommodate operators of differing heights.

When the operator desires to tilt the surface 18 the operator merely rotates the handle 74 to achieve the desired tilt.

The use of a rechargeable battery 84 as opposed to an internal combustion engine or a cord operated electrical motor, makes the screed device 10 independent of wall outlets and also very light. It also eliminates the safety hazards caused by cords which may drag in the wet concrete or caused by the high temperatures and exhaust fumes of internal combustion engines.

Figure 2:
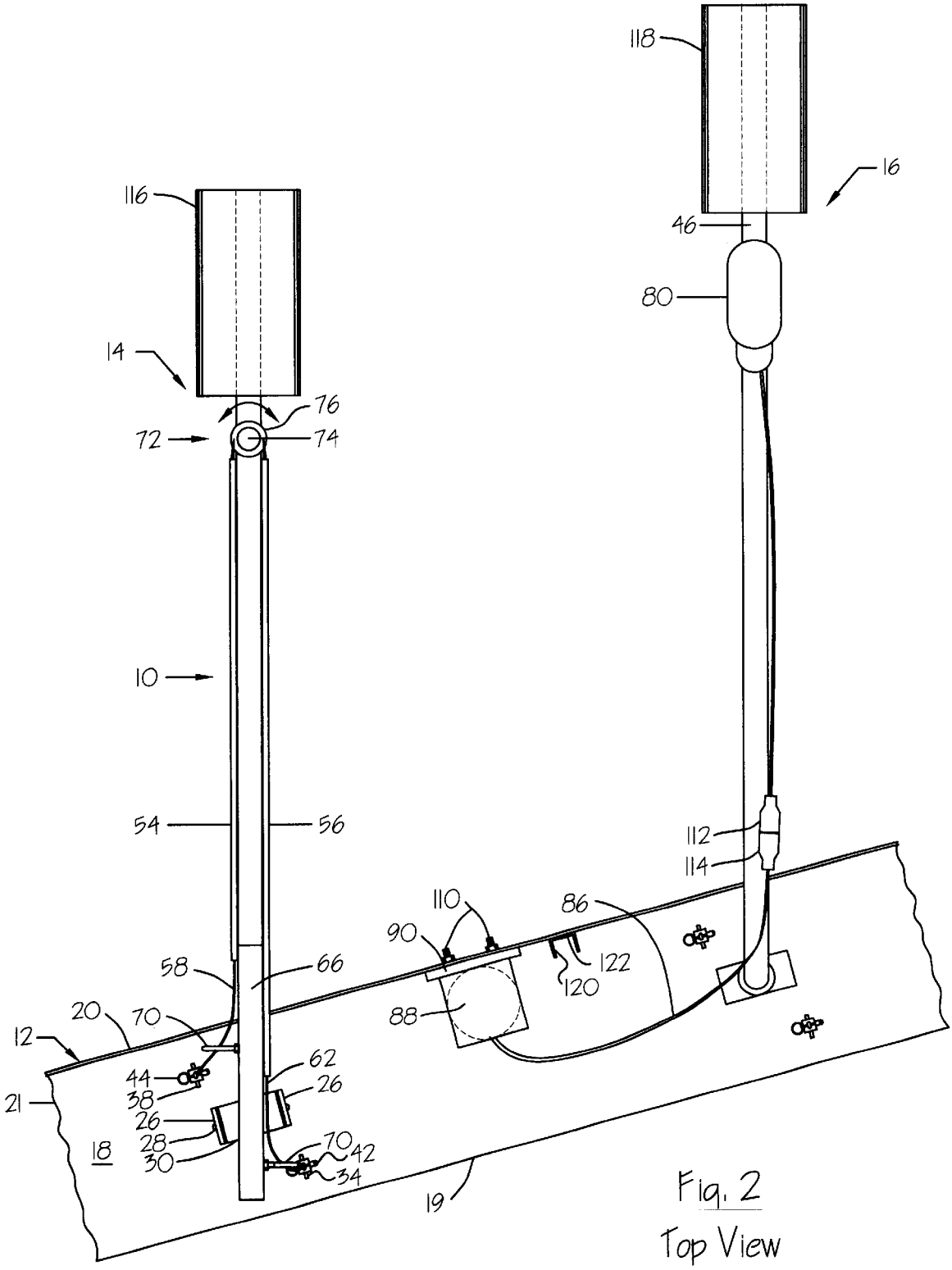
FIG. 2 is a view similar to FIG. 1, but showing the screed plate at an angle relative to the two handles.

Referring to FIGS. 1 and 2, a plurality of bolts 110 attach the motor mount 90 to the vertical screed surface 20 for mounting the variable speed motor 88. Also, wire 86 includes a pair of plug members 112, 114 which may be separated in order to remove arm 16 from the device. Arms 14, 16 each include at their upper ends a padded arm rest 116, 118 respectively.

The present invention is adapted for use with a laser device which can be used with a horizontal laser beam to provide orientation as to whether or not the concrete surface is level or out of level. A U-shaped laser mount bracket 120 is mounted to the vertical surface 20 of screed plate 12. Bracket 120 may be bolted or may be welded as desired. Between the two U-shaped arms of the bracket 120 is a rubber washer 122 which helps absorb vibrations. The bracket 120 is shown in use with a laser device in FIGS. 6 and 7. A vertical laser post 124 is bolted by means of bolts 126 to the U-shaped bracket 120 and extends upwardly therefrom. At the upper end of laser post 124 is a laser receiver 128 conventionally known in the art. The receiver 128 is adapted to receive a laser beam 130 and indicate whether or not it is higher or lower with respect to that laser beam 130. Thus the operator by looking at the receiver 128 can determine whether or not the concrete surface is low or high relative to the laser beam 130.

Extending from the laser post 124 is a horizontal arm 131 which at its end is pivotally attached to a leveling strap 132. Leveling strap 132 is in turn attached to a turn buckle 134 which is pivotally connected to the arm 116.

The turn buckle 134 permits adjustment of the height of the arm 16 to the operator. If the operator is tall the turn buckle is tightened to lift the arm 116 and if the operator is short the turn buckle 134 is lengthened to permit lowering of the arm 116.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A concrete screed comprising:

a screed plate having first and second opposite ends, a leading edge, a trailing edge, and a flat bottom surface;

a vibrator mounted on said screed plate and being capable of actuation to cause vibration of said screed plate;

a first elongated arm and a second elongated arm, said first and second elongated arms each having a handle end for grasping by an operator and a lower end;

first and second hinge mechanisms mounting said lower ends of said first and second arms respectively to said screed plate for independent pivotal movement with respect to said screed plate about spaced apart;

said first and second hinge mechanisms also permitting independent pivotal movement of said first and second arms about first and second horizontal axes respectively with respect to said screed plate;

a power source connected to said vibrator for actuating said vibrator to cause vibration of said screed plate.

2. A concrete screed according to claim 1 wherein said power source comprises a rechargeable battery, and said vibrator comprises an electric motor.

3. A concrete screed according to claim 2 wherein said vibrator further comprises an eccentric wheel driven by said motor and engaging said screed plate.

4. A concrete screed according to claim 3 and further comprising a control connected to said electric motor for controlling the actuation of said electric motor, said control being mounted adjacent said handle end of one of said arms.

5. A concrete screed according to claim 1 and further comprising a leveling mechanism for raising and lowering said leading and trailing edges of said screed plate relative to one another.

6. A concrete screed according to claim 5 wherein said leveling mechanism comprises first and second flexible members each having a lower end connected to said screed plate adjacent said leading and trailing edges thereof respectively, and each having an upper end.

7. A concrete screed according to claim 6 wherein said leveling mechanism further comprises a leveling control mounted adjacent said handle end of one of said first and second arms and being connected to both of said upper ends of said first and second flexible members.

8. A method for preparing a concrete surface comprising:

taking a screed plate comprising first and second opposite ends, a leading edge, a trailing edge, a flat bottom surface, and a longitudinal axis extending between said first and second opposite ends;

placing said flat bottom surface of said screed plate on said concrete surface before said concrete has completely cured;

vibrating said screed plate;

grasping first and second arms to move said screed plate across said concrete surface, said first and second arms each having handle ends and also each having lower ends pivotally connected to said screed plate for independent pivotal movement about first and second spaced apart upstanding axes respectively and for independent pivotal movement about first and second horizontal axes respectively;

pivoting said screed plate about said first and second upstanding axes relative to said first and second arms by pushing on said first arm and pulling on said second arm to change the angle of said screed plate relative to said first and second arms.

9. A method according to claim 8 and further comprising independently pivoting said first and second arms about said first and second horizontal axes respectively to cause independent adjustment of the height of said handle ends of said first and second arms.

10. A method according to claim 8 wherein said screed plate includes a downwardly presented flat screed surface engaging said concrete, said screed plate having a leading edge and a trailing edge, said method further comprising pivoting said screed plate about said first and second horizontal axes relative to said first and second arms to cause raising or lowering of said leading edge relative to said trailing edge, and thereby changing the angle at which said screed surface engages said concrete.

11. A method according to claim 10 wherein said pivoting of said screed plate about said first and second horizontal axes is accomplished by pulling on a first flexible member attached to said screed plate adjacent said leading edge thereof or by pulling on a second flexible member attached to said screed plate adjacent said trailing edge thereof.

12. A method according to claim 11 and further comprising attaching said first and second flexible members to a control mechanism on one of said first and second arms, and using said control mechanism to selectively pull on said first or second flexible members.

* * * * *